US009060664B2

(12) United States Patent
Park

(10) Patent No.: US 9,060,664 B2
(45) Date of Patent: Jun. 23, 2015

(54) DISHWASHER AND METHOD OF CONTROLLING THE SAME

(75) Inventor: Nung Seo Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 532 days.

(21) Appl. No.: 12/254,959

(22) Filed: Oct. 21, 2008

(65) Prior Publication Data

US 2009/0133719 A1 May 28, 2009

(30) Foreign Application Priority Data

Oct. 22, 2007 (KR) ..... 10-2007-0106223

(51) Int. Cl.
*A47L 15/00* (2006.01)

(52) U.S. Cl.
CPC ..... *A47L 15/0049* (2013.01); *A47L 15/0023* (2013.01); *A47L 15/0031* (2013.01); *A47L 2401/09* (2013.01); *A47L 2501/01* (2013.01); *A47L 2501/05* (2013.01)

(58) Field of Classification Search
CPC ..... A47L 15/001; A47L 15/0031; A47L 15/4223; A47L 15/0049; A47L 2501/02; A47L 2501/05; A47L 2501/01
USPC ..... 222/651, 652; 134/25.2, 18, 56 D, 200
See application file for complete search history.

(56) References Cited

U.S. PATENT DOCUMENTS

| | | | | |
|---|---|---|---|---|
| 3,810,480 | A * | 5/1974 | Smith et al. | 134/104.1 |
| 5,525,161 | A * | 6/1996 | Milocco et al. | 134/18 |
| 2005/0000544 | A1* | 1/2005 | Cho et al. | 134/18 |
| 2005/0028850 | A1* | 2/2005 | Nito et al. | 134/200 |
| 2005/0241675 | A1* | 11/2005 | Jung et al. | 134/18 |

FOREIGN PATENT DOCUMENTS

| | | | | |
|---|---|---|---|---|
| CN | 101011229 | | 8/2007 | |
| EP | 1 942 219 | | 7/2008 | |
| EP | 1942219 | A1 * | 7/2008 | D06F 33/02 |
| JP | 09-28648 | A | 2/1997 | |
| JP | 2004-129772 | A | 4/2004 | |
| KR | 10-0269386 | B1 | 7/2000 | |
| KR | 10-2005-0016147 | A | 2/2005 | |

OTHER PUBLICATIONS

European Search Report dated Nov. 13, 2014.

* cited by examiner

*Primary Examiner* — Michael Kornakov
*Assistant Examiner* — Katelyn Whatley
(74) *Attorney, Agent, or Firm* — Ked & Associates, LLP

(57) ABSTRACT

Disclosed is a dishwasher, which prevents a washing cycle from being carried out in an insufficient state of washing water caused by the continuous discharge of the washing water due to a siphon action, and a method of controlling the dishwasher. The method includes draining washing water from the dishwasher; supplying the washing water to the inside of the dishwasher; and temporarily stopping the supply of the washing water for a designated time between the drain of the washing water and the supply of the washing water.

6 Claims, 6 Drawing Sheets

DISHWASHER AND METHOD OF CONTROLLING THE SAME

This application claims the benefit of Korean Patent Application No. 10-2007-0106223, filed on Oct. 22, 2007, which is hereby incorporated by reference as if fully set forth herein.

BACKGROUND OF THE INVENTION

1. Field of the Invention

The present invention relates to a dishwasher and a method of controlling the same, and more particularly, to a method of controlling supply and drain of washing water in a dishwasher.

2. Discussion of the Related Art

Dishwashers are electric home appliances for kitchens, which separate residue of food, such as grains of boiled rice, from dishes using high-pressure washing water, and thus, wash the dishes.

In general, a dishwasher includes a main body forming an external appearance of the dishwasher, a washing tub provided in the main body to form a washing space, a sump provided under the washing tub to supply and collect washing water, and spray arms to spray the washing water supplied from the sump to dishes.

The sump includes a water supply channel and a water supply valve to supply the washing water to the sump, a drain channel and a drain pump to drain the washing water in the sump, a pump to supply the washing water stored in the sump to the spray arms at a designated pressure, and a heater to heat the washing water stored in the sump.

An air guide to maintain the pressure in a washing tub and the external pressure equally is provided in an washing tub, and a water level sensor to sense a level of the washing water stored in the sump is provided in the sump.

Hereinafter, supply and drain of washing water in the above-described dishwasher will be described.

First, washing water is supplied to the sump of the dishwasher through the water supply channel and the water supply valve, and when the washing water reaches a designated level in the sump, the supply of the washing water is stopped.

After the completion of the supplying of the washing water to the sump, the pump is operated, and thus, pumps the washing water in the sump to the spray arms, and the spray arms spray the washing water onto dishes located in the washing tub to perform a washing cycle (or a rinsing cycle).

When the washing cycle has been completed, the washing water used in the washing cycle is drained to the outside of the dishwasher through the drain channel and the drain pump. Then, the drained washing water level is sensed by the water level sensor.

When the water level sensor senses that the washing water has been completely drained from the sump, the drain pump is further driven for a designated time to drain any remaining washing water, which has not been sensed by the water level sensor, and then is stopped.

In order to perform an additional washing cycle or rinsing cycle, the washing water is supplied again to the sump. This process may be repeatedly performed during dish washing (or a rinsing cycle).

While the drain of the washing water is converted into the supply of the washing water, as described above, the supplied washing water may be continuously drained through the drain channel.

For example, during the supply of the washing water, power supplied to the drain pump is cut off. However, the washing water supplied to the sump is drained through the drain channel due to inertial operation of the drain pump, which was operated during the draining of the washing water.

Further, in a case that an end terminal of the drain channel is located at a position lower than a level of the washing water in the sump, the washing water supplied to the sump may be continuously drained due to the above-described drain action caused by the inertial operation of the drain pump and a siphon action generated between the sump and the drain channel.

In a case that a part of the washing water supplied to the sump is drained through the drain channel, as described above, the washing water supplied to the sump is insufficient, and thus, a washing (or rinsing) efficiency is lowered.

Further, in a case that the washing (or rinsing) cycle is performed under a condition that the washing water is excessively insufficient, an excessively high load is applied to the pump pumping the washing water to the spray arms and the heater heating the washing water, and thus, components of the dishwasher may be damaged.

SUMMARY OF THE INVENTION

Accordingly, the present invention is directed to a dishwasher and a method of controlling the same.

One object of the present invention is to provide a dishwasher, in which supply and drain of washing water are improved, and a method of controlling the dishwasher.

To achieve this object and other advantages and in accordance with the purpose of the invention, as embodied and broadly described herein, a dishwasher includes a sump; a water supply device to supply washing water to the inside of the sump; a drain device to drain the washing water in the sump to the outside of the dishwasher; and a control device to stop the supply of the washing water for a designated time after the operation of the drain device has been finished.

Preferably, the control device stops the supply of the washing water by stopping the operation of the dishwasher.

Preferably, the control device stops the supply of the washing water by stopping the operation of the water supply device.

Preferably, the control device stops the supply of the washing water for a shorter time than the operating time of the water supply device.

Preferably, the control device stops the supply of the washing water for a shorter time than the operating time of the drain device.

Preferably, the dishwasher further comprises a water level sensor to sense the level of the washing water drained by the drain device, and the control device further operates the drain device for a designated time to drain the remainder of the washing water, which is not drained, according to the sensing of the water level sensor.

In another aspect of the present invention, a method of controlling a dishwasher includes draining washing water from the dishwasher; supplying the washing water to the inside of the dishwasher; and temporarily stopping the supply of the washing water for a designated time between the drain of the washing water and the supply of the washing water.

Preferably, the stoppage of the supply of the washing water is carried out by stopping the operation of a water supply valve.

Preferably, the stoppage of the supply of the washing water is carried out by stopping the operation of the dishwasher.

Preferably, the stoppage of the supply of the washing water is carried out for a shorter time than a water supply time, for which the washing water is supplied to the dishwasher.

Preferably, the stoppage of the supply of the washing water is carried out for a shorter time than a drain time, for which the washing water is drained from the dishwasher.

Preferably, wherein the stoppage of the supply of the washing water includes sensing the level of the drained washing water; and additionally draining the remainder of the washing water, which is not drained, after the sensing of the level of the drained washing water.

In another aspect of the present invention, a method of controlling a dishwasher, which has supplying washing water to the inside of the dishwasher; washing dishes in the dishwasher using the washing water; and draining the washing water from the dishwasher, includes temporarily stopping the supply of the washing water for a designated time between the drain of the washing water and the supply of the washing water when the drain of the washing water is converted into the supply of the washing water to repeatedly perform the respective operations.

Preferably, the stoppage of the supply of the washing water is carried out by stopping the operation of a water supply valve.

Preferably, the stoppage of the supply of the washing water is carried out by stopping the operation of the dishwasher.

Preferably, the stoppage of the supply of the washing water is carried out for a shorter time than a water supply time, for which the washing water is supplied to the dishwasher.

Preferably, the stoppage of the supply of the washing water is carried out for a shorter time than a drain time, for which the washing water is drained from the dishwasher.

Preferably, the stoppage of the supply of the washing water includes sensing the level of the drained washing water; and additionally draining the remainder of the washing water, which is not drained, after the sensing of the level of the drained washing water.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a dishwasher in accordance with a preferred embodiment of the present invention will be described in detail with reference to accompanying drawings.

Figure 1:
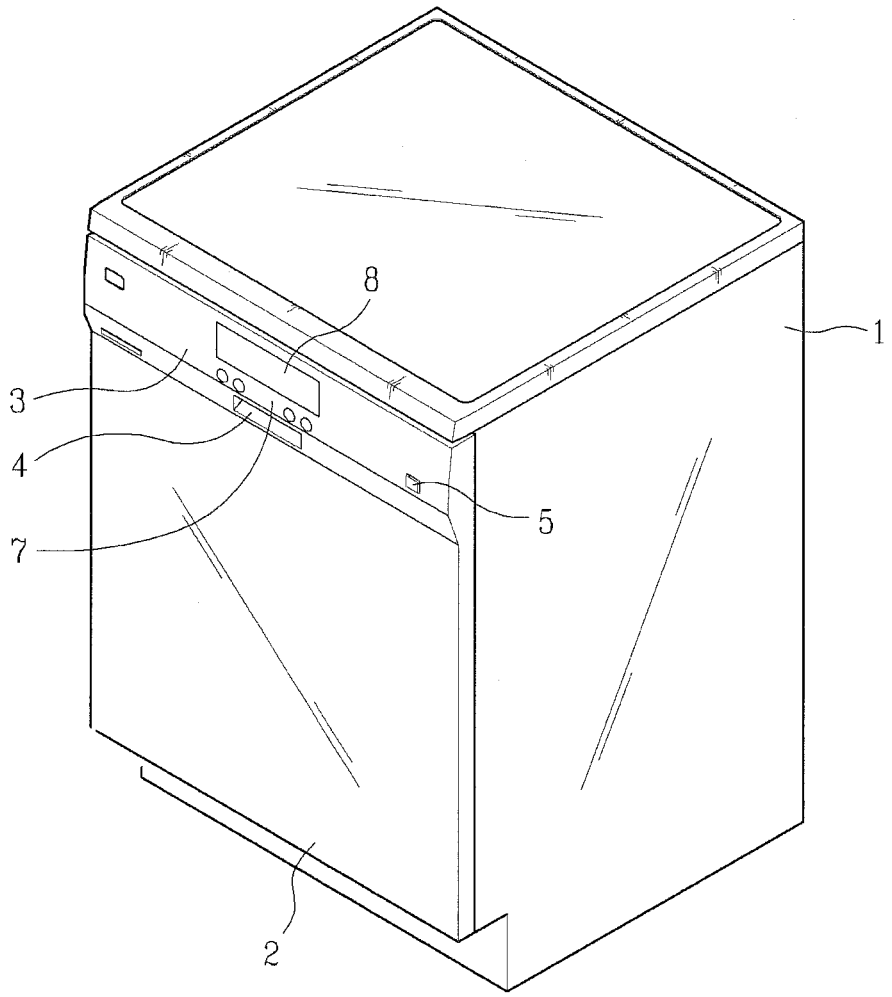
FIG. 1 is a perspective view illustrating a dishwasher in accordance with an embodiment of the present invention.

FIG. 1 is a perspective view illustrating a dishwasher in accordance with an embodiment of the present invention.

With reference to FIG. 1, the dishwasher of the present invention includes a case 1 forming the an external appearance of the dishwasher and provided with an opening, through which dishes are put into the case 1, a door 2 to open and close the opening of the case 1, and a control panel 3 provided at an external surface of the case 1 to display and control operation of the dishwasher.

The control panel 3 includes a power switch 5 to turn on/off power of the dishwasher, a function manipulation unit 7 to control the operation of the dishwasher by the manipulation of a user, and a display unit 8 to display setting and operating states of the dishwasher. Further, a door handle 4 used to open and close the door 2 is further provided on the door 2.

Figure 2:
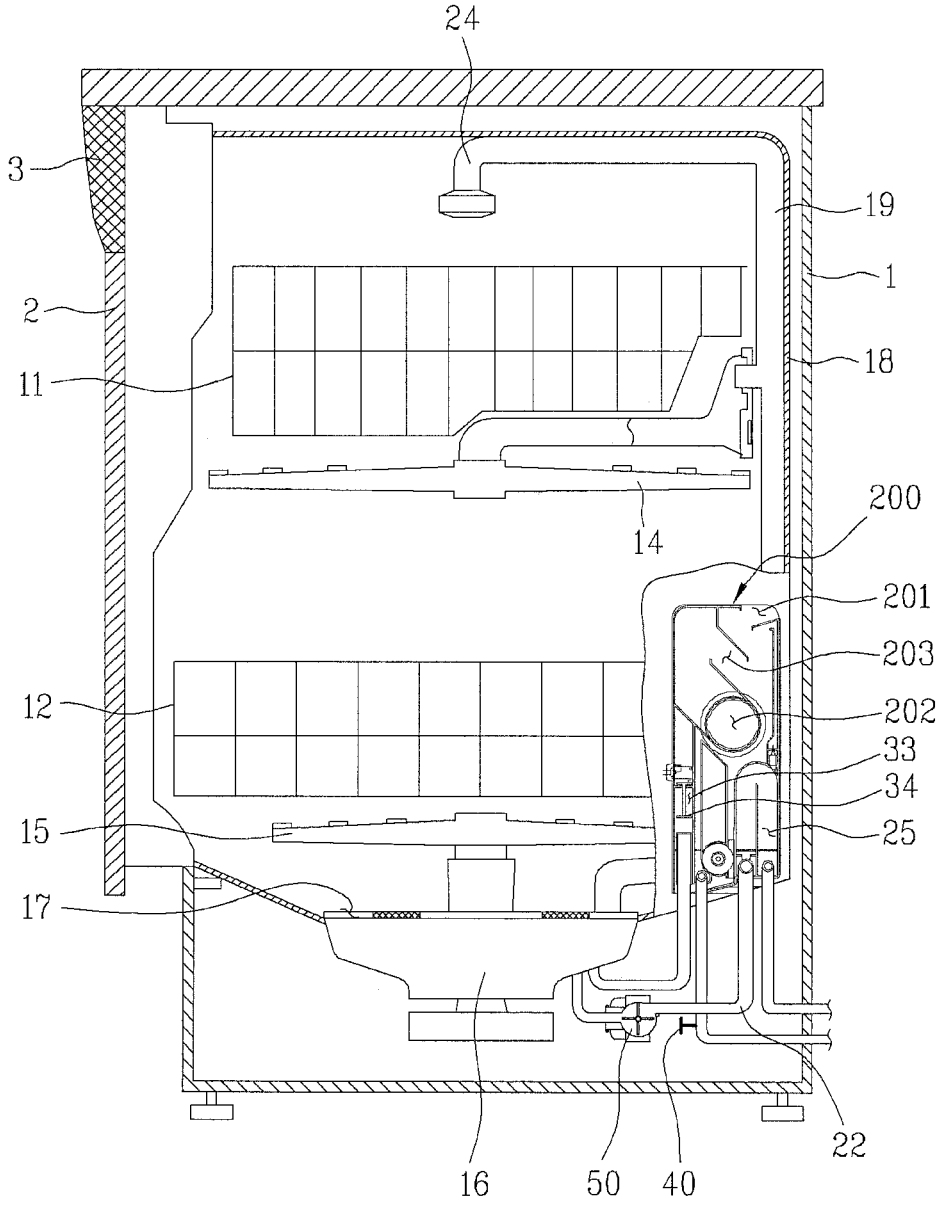
FIG. 2 is a longitudinal-sectional view illustrating the internal structure of the dishwasher in accordance with the embodiment of the present invention.

FIG. 2 is a longitudinal-sectional view illustrating internal structure of the dishwasher in accordance with the embodiment of the present invention.

With reference to FIG. 2, the internal structure of the dishwasher of the present invention will be described.

In the dishwasher, a washing tub 18 providing a space, in which the dishes are washed, a sump 16 formed under the washing tub 18 to store washing water to wash the dishes, and a plurality of spray arms 14, 15, and 24 to receive the washing water stored in the sump 16 and spray the washing water to the dishes placed in the washing tub 18 are provided.

The washing tub 18 includes an upper rack 11 and a lower rack 12 to receive a plurality of dishes in the washing tub 18. Further, the spray arms 14, 15, and 24 to spray the washing water upward or downward onto the upper rack 11 and the lower rack 12 are provided below or above the upper rack 11 and the lower rack 12.

An air guide 200 to cause external air and air in the washing tub 18 to communicate with each other is provided in the washing tub 18. The inside of the washing tub 18 can be maintained in an atmospheric pressure state at any time by the air guide 200.

The air guide 200 includes an air inlet 201, through which external air is inhaled, an opening 202 that communicates with air in the washing tub 18, and an air channel 203 connecting the air inlet 201 and the opening 202.

Since the inside of the washing tub 18 can be maintained in the atmospheric pressure state at any time by the air guide 200, it is possible to prevent the pressure in the washing tub 18 from being raised due to steam or high-temperature air. Thus, a danger of explosion generated when the pressure in the washing tub 18 is raised, in particular a possibility of inflicting an injury on a user due to high pressure in the washing tub 18 and high-temperature washing water when the user opens the door 2 during the operation of the dishwasher, is prevented.

The sump 16 includes a water supply channel 33 located in a lower portion of the washing tub 18 to supply the washing water, a drain channel 25 to drain the washing water, which has completed the washing and rinsing of the dishes, and a washing water channel 19 to provide the washing water stored in the sump 16 to the respective spray arms 14, 15, and 24. An inflow hole 17 to collect the washing water after the washing or rinsing of the dishes is formed through an upper surface of the sump 16.

The water supply channel 33 serves to supply the washing water, supplied from an external water supply source (not shown), such as a tap, to the sump 16. The water supply channel 33 is provided with a water supply valve 40 to adjust the supply of the washing water. Further, the water supply channel 33 is further provided with a water level sensor 34 to sense an amount of the washing water supplied to and stored in the sump 16.

The drain channel 25 serves to drain the washing water in the sump 16, which has completed the washing and rinsing of the dishes. The drain channel 25 is provided with a drain pump 50 to drain the washing water stored in the sump 16. The drain channel 25 is preferably formed in a reversed U shape passing through a higher position than a level of the washing water in the sump 16, and this shape of the drain channel 25 prevents a siphon action due to the drain channel 25.

The washing water channel 19 serves to provide the washing water, supplied to the sump 16 through the water supply channel 33 or collected in the sump 16 through the inflow hole 17, to the spray arms 14, 15, and 24. The washing water channel 19 is provided with a pump (not shown) to supply the washing water to the spray arms 14, 15, and 24 at a designated pressure.

Figure 3:
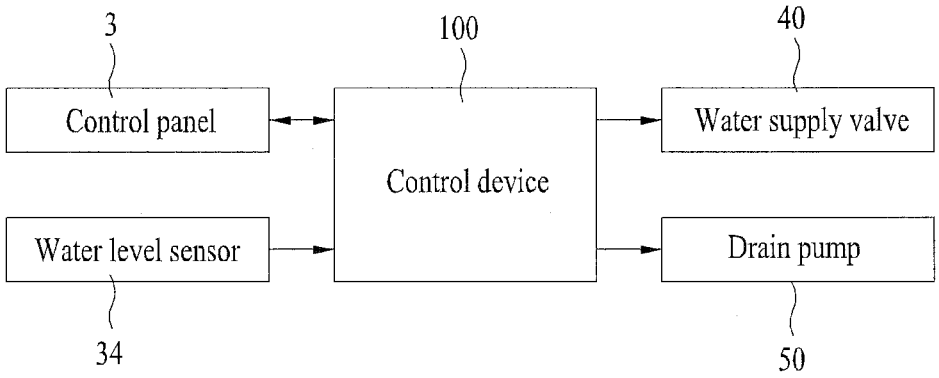
FIG. 3 is a block diagram illustrating the configuration of the dishwasher in accordance with the embodiment of the present invention.

The water supply valve 40 of the water supply channel 33 and the drain pump 50 of the drain channel 25 are controlled by a control device 100, and the control device 100 controls the water supply valve 40 and the drain pump 25 according to the amount of the washing water in the sump 16 sensed by the water level sensor 34 (with reference to FIG. 3).

Hereinafter, operation of the dishwasher in accordance with an embodiment of the present invention will be described. Respective elements, which will be described later, will be understood with reference to the above description and FIG. 1.

The dishwasher in accordance with the embodiment sequentially or selectively performs preliminary washing, main washing, rinsing, heat-rinsing, and drying cycles to wash dishes. Hereinafter, a washing cycle will be exemplarily described. However, the present invention is not limited to the washing cycle, but may be applied to other cycles, such as a rinsing cycle including a process of converting the drain of the washing water into the supply of the washing water.

First, the operation of the dishwasher in accordance with the embodiment will be described. When a user wants to perform washing of dishes, the user places the dishes on the racks 11 and 12, and closes the door 2.

Thereafter, when the user selects a desired washing state of the dishes and starts the operation of the dishwasher by manipulating the function manipulation unit 7 provided on the control panel 3, the operation of the dishwasher is carried out under a condition that the operating state of the dishwasher is displayed on the display unit 8 of the control panel 3.

Figure 4:
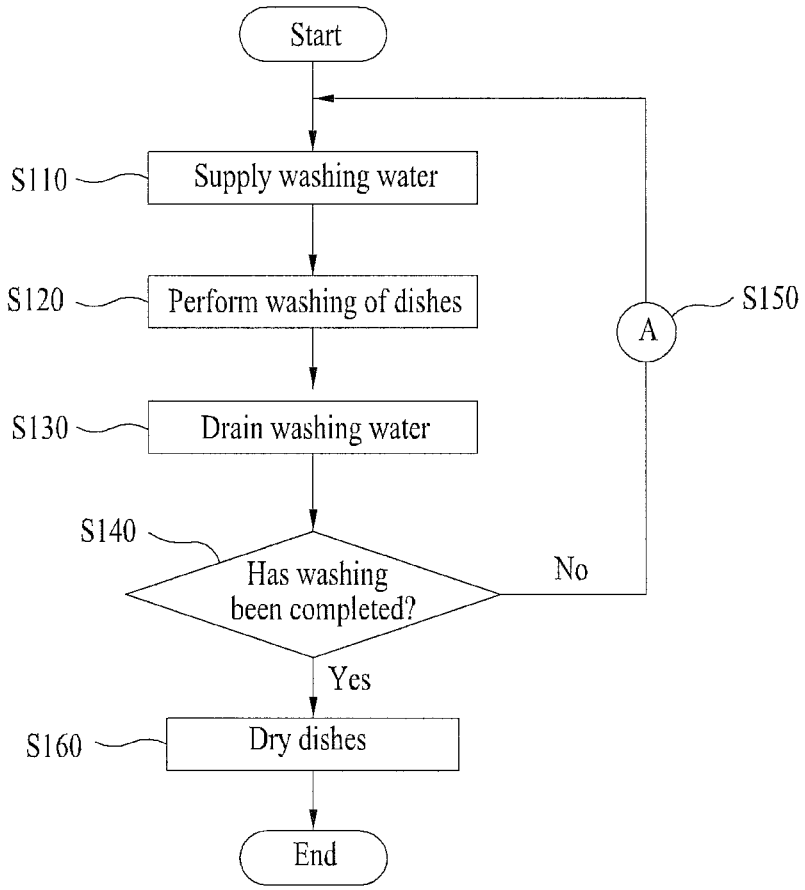
FIG. 4 is a flow chart illustrating the operation of the dishwasher in accordance with the embodiment of the present invention.

Hereinafter, the operation of the dishwasher focusing on the flow of the washing water in the washing tub 18 will be described. FIG. 4 is a flow chart illustrating the operation of the dishwasher in accordance with the embodiment of the present invention.

With reference to FIG. 4, when the operation of the dishwasher is started, the control device 100 (with reference to FIG. 3) opens the water supply valve 40, and thus washing water is supplied to the inside of the sump 16 through the water supply channel 33 (operation S110).

Thereafter, the washing water supplied to the inside of the sump 16 is supplied to the spray arms 14, 15, and 24 by the pump (not shown), and is sprayed onto dishes loaded on the racks 11 and 12 by the spray arms 14, 15, and 24, thus washing the dishes (operation S120).

The washing water sprayed from the spray arms 14, 15, and 24 washes the dishes placed on the racks 11 and 12, and then is dropped down and collected in the sump 16 through the inflow hole 17 formed through the upper surface of the sump 16. The washing water collected in the sump 16 is supplied again to the spray arms 14, 15, and 24 through the washing water channel 19 by the pump, and washes the dishes.

Thereafter, when the washing of the dishes by the washing water sprayed by the spray arms 14, 15, and 24 has been completed, the drain pump 50 is driven and thus discharges the washing water in the sump 16 to the outside. That is, the drain pump 50 is operated by the control device 100, and thus discharges the washing water collected in the sump 16 to the outside through the drain channel 25 (operation S130).

Then, the control device 100 determines whether or not the washing cycle has been completed so as to repeatedly perform the above-described process (operation S140).

In case that the washing cycle has not been completed, the drain of the washing water and the supply of the washing water are controlled so as to repeatedly perform the supply of the washing water, the washing of the dishes, and the drain of the washing water (operation S150).

On the other hand, in case that the washing cycle has been completed, the heater on the bottom surface of the washing tub 18 is driven, and thus dries the dishes (operation S160). Thereby, the operation of the dishwasher is completed.

In case that the washing cycle has not been completed as a result of the determination of operation S140, the supply of the washing water is performed after the drain of the washing water, and then the washing of the dishes and the drain of the washing water are repeated.

Hereinafter, a process of converting the drain of the washing water into the supply of the washing water (operation S150) to repeatedly perform the washing cycle will be described.

Figure 5:
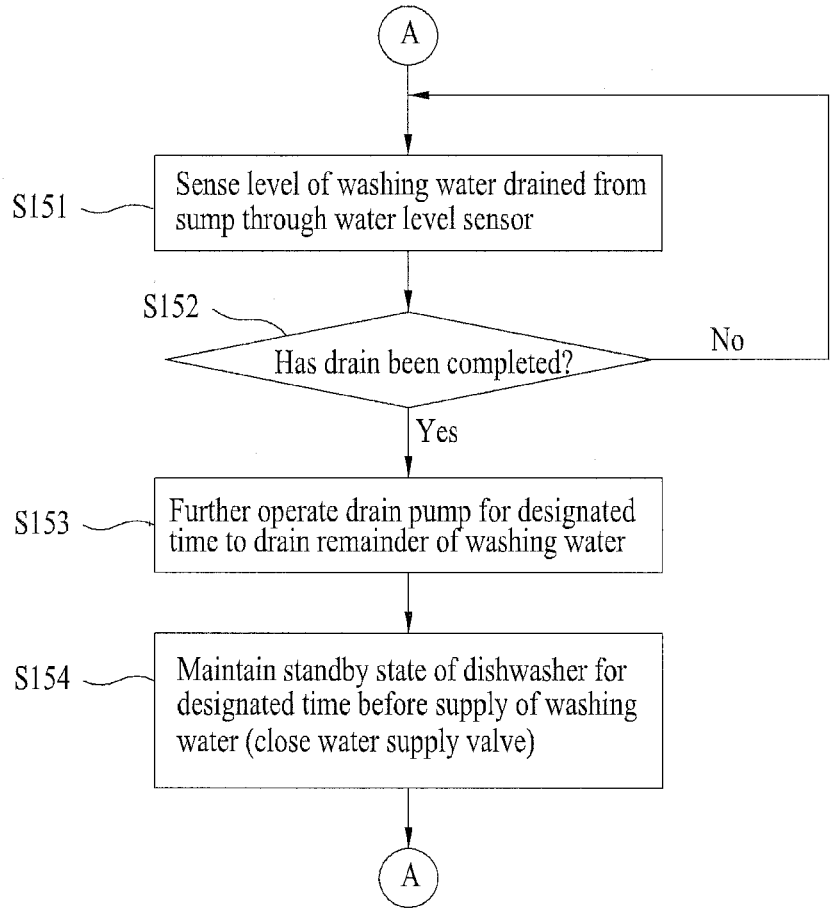
FIG. 5 is a flow chart illustrating the supply of washing water and the drain of the washing water during the operation of the dishwasher in accordance with the embodiment of the present invention.

FIG. 5 is a flow chart illustrating the supply of washing water and the drain of the washing water during the operation of the dishwasher in accordance with the embodiment of the present invention.

First, the control device 100 drives the drain pump 50 to drain the washing water stored in the sump 16, and thus allows the washing water in the sump 16 to be drained (operation 151).

At this time, the water level sensor 34 senses the level of the washing water drained from the sump 16 and transmits the sensed level to the control device 100, and the control device 100 determines whether or not the drain of the washing water in the sump 16 has been completed (operation 152).

In a case that it is determined the washing water in the sump 17 has not been completely drained by the sensing of the water level sensor 34, the control device 100 continuously drives the drain pump 50 such that the drain of the washing water in the sump 17 can be completed.

In a case that it is determined the washing water in the sump 17 has been completely drained by the sensing of the water level sensor 34, the control device 100 further drives the drain pump 50 for a designated time. That is, in order to drain any remaining washing water in the sump 16, which has not been sensed by the water level sensor 34, the drain pump 50 is further driven for the designated time (operation S153).

Here, the discharged washing water serves to prevent the washing water in the sump 16 from being discharged due to a siphon action caused by the communication of external air and internal air through the air inlet 201 of the air guide 200.

However, the above process cannot completely prevent the siphon action through the air inlet 201.

Therefore, when the control 100 stops the drain pump 50 and simultaneously opens the water supply valve 40, the control device 100 cannot prevent the supplied washing water from being directly discharged due to the inertial operation of the drain pump 50 and the siphon action. For this reason, the supply of the washing water is stopped for a designated time so as to completely stop the inertial operation of the drain pump 50 (operation S154).

Figure 6:
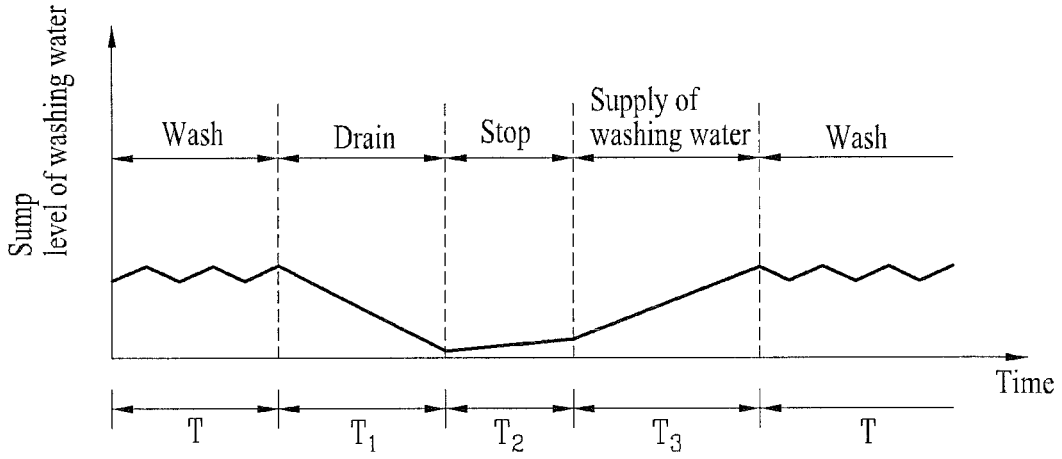
FIG. 6 is a graph illustrating a variation of the level of the washing water in a sump according to the operation of the dishwasher in accordance with the embodiment of the present invention.

Preferably, the designated time, i.e., a stopping time (T2), for which the supply of the washing water is stopped, is shorter than the driving time (T3) of the water supply valve 40 and the driving time (T1) of the drain pump 50 (with reference to FIG. 6).

The reason why the stopping time (T2) of the supply of the washing water is shorter than the driving time (T3) of the water supply valve 40 and the driving time (T1) of the drain pump 50 is that the excessively long stopping time (T2) causes an increase of the overall time of the dishwasher taken to perform the cycle.

The stoppage of the supply of the washing water may be carried out by closing the water supply valve 40. Alternately, the stoppage of the supply of the washing water may be carried out by temporarily stopping the overall operation of the dishwasher.

After the stopping time (T2) of the supply of the washing water has elapsed, the control device 100 repeatedly performs the supply of the washing water (operation S110), the washing of the dishes (operation S120), and the drain of the washing water (operation S130), thus performing a dish washing process.

The above embodiment describes that the supply of the washing water is stopped temporarily between the drain of the washing water and the supply of the washing water during the washing of dishes. However, the method of the present invention is not limited to the washing of the dishes, but may be applied to any time between the drain of the washing water and the supply of the washing water.

As described above, as the supply of the washing water is stopped for a designated time between the draining of the washing water and the supply of the washing water during the washing of dishes, it is possible to prevent the washing water supplied to the sump 16 from being drained due to a siphon action relating to internal operation of the drain pump 50.

Further, as the draining of the washing water is prevented, it is possible to prevent an excessive large load from being applied to the pump and the heater of the dishwasher due to insufficiency of the washing water. Moreover, as the supply of the washing water is stopped for a designated time between the draining of the washing water and the supply of the washing water, noise generated during an overall operation of the dishwasher is reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling a dishwasher, the method comprising:

supplying washing water into a washing tub of the dishwasher from outside of the dishwasher by opening a water supply valve a first time for a first predetermined period of time, in order to perform a first supply of washing water into the washing tub for a first washing cycle;

after completion of the first washing cycle, draining the washing water from the washing tub to outside of the dishwasher by operating a drain pump;

stopping operation of the drain pump;

supplying washing water into the washing tub from outside of the dishwasher by opening the water supply valve a second time for a second predetermined period of time, in order to perform a second supply of washing water into the washing tub from outside of the dishwasher for a first rinsing cycle or a second washing cycle; and providing a third predetermined period of time between the stopping of the operation of the drain pump and the supplying of the washing water into the washing tub from outside of the dishwasher by the opening of the water supply valve the second time, in order to prevent discharge of the washing water, due to inertial operation of the drain pump, during the supplying of the washing water into the washing tub by the opening of the water supply valve a second time, wherein the third predetermined period of time prevents a siphon effect.

2. The method of claim 1, wherein the draining of the washing water from the washing tub by the operating of the drain pump and the stopping of the operation of the drain pump comprise:

sensing a level of the washing water in a sump of the washing tub during the draining of the washing water from the washing tub by the operating of the drain pump;

further operating the drain pump for a fourth predetermined period of time if the level has reached a predetermined level; and stopping the operation of the drain pump after the fourth predetermined period of time has elapsed.

3. The method of claim 2, wherein the draining of the washing water from the washing tub by the operating of the drain pump, and the stopping of the operation of the drain pump further comprise:

continuously operating the drain pump if the level has not reached the predetermined level.

4. The method of claim 1, wherein the draining of the washing water from the washing tub by the operating of the drain pump comprises:

draining the washing water through a drain channel having a reversed U shape, such that the draining washing water passes through a portion higher than a level of washing water in a sump of the dishwasher.

5. The method of claim 1, wherein the third predetermined period of time is shorter than the first and second predetermined periods of time.

6. A method of controlling a dishwasher, the method comprising:

supplying washing water into a washing tub of the dishwasher from outside of the dishwasher by opening a water supply valve a first time for a first predetermined period of time, in order to perform a first supply of washing water into the washing tub for a first washing cycle;

after completion of the first washing cycle, draining the washing water from the washing tub to outside of the dishwasher by operating a drain pump;

sensing a level of the washing water in a sump of the washing tub during the draining of the washing water from the washing tub by the operating of the drain pump;

further operating the drain pump for a second predetermined period of time if the level has reached a predetermined level;

stopping the operation of the drain pump after the second predetermined period of time has elapsed;

providing a third predetermined period of time between the stopping of the operation of the drain pump and supplying of washing water into the washing tub from outside of the dishwasher by opening of the water supply valve a second time for a fourth predetermined period of time, wherein the third predetermined period of time prevents discharge of the washing water, due to inertial operation of the drain pump, during the supplying of the washing water into the washing tub by the opening of the water supply valve the second time, and wherein the second and third predetermined periods of tune prevent a siphon effect.

* * * * *